US005357859A

United States Patent [19]

Eckert

[11] Patent Number: 5,357,859

[45] Date of Patent: Oct. 25, 1994

[54] MATERIAL WEB TURNING BAR ASSEMBLY

[75] Inventor: Günther O. Eckert, Zellingen, Fed. Rep. of Germany

[73] Assignee: Koenig & Bauer Aktiengesellschaft, Fed. Rep. of Germany

[21] Appl. No.: 103,913

[22] Filed: Aug. 10, 1993

[30] Foreign Application Priority Data

Aug. 10, 1992 [DE] Fed. Rep. of Germany ..... 4226386
Apr. 7, 1993 [DE] Fed. Rep. of Germany ..... 4311437

[51] Int. Cl.[5] ..... B41F 13/54

[52] U.S. Cl. ..... 101/228; 101/225

[58] Field of Search ..... 101/228, 225, 227, 222, 101/223, 230, 231, 219, 178–180; 226/197, 199, 200; 270/5, 6

[56] References Cited

U.S. PATENT DOCUMENTS

| | | | |
|---|---|---|---|
| 1,610,671 | 12/1926 | Funk | 226/197 |
| 2,904,333 | 9/1959 | Fife | 226/198 |
| 3,623,645 | 11/1971 | Klingler | 226/197 |
| 4,842,430 | 6/1989 | Yamazaki | 101/223 |
| 4,863,087 | 9/1989 | Kohler | 226/197 |
| 5,040,359 | 8/1991 | Thimon | 53/556 |
| 5,077,956 | 1/1992 | Thimon | 53/399 |
| 5,097,655 | 3/1992 | Thimon | 53/588 |
| 5,100,117 | 3/1992 | Hajek et al. | 270/52 |
| 5,108,022 | 4/1992 | Birkmair et al. | 226/197 |

FOREIGN PATENT DOCUMENTS

| | | | |
|---|---|---|---|
| 0134007 | 3/1985 | European Pat. Off. | 101/219 |
| 0342491 | 5/1989 | European Pat. Off. . | |
| 0411981 | 7/1990 | European Pat. Off. . | |
| 2920684 | 11/1980 | Fed. Rep. of Germany . | |
| 3131621 | 6/1982 | Fed. Rep. of Germany . | |
| 8429553.3 | 2/1985 | Fed. Rep. of Germany . | |
| 4013229 | 11/1991 | Fed. Rep. of Germany . | |

*Primary Examiner*—Edgar S. Burr
*Assistant Examiner*—Anthony H. Nguyen
*Attorney, Agent, or Firm*—Jones, Tullar & Cooper

[57] ABSTRACT

A material web turning bar assembly utilizes one fixed lead screw and support spindle and one shiftable lead screw and support spindle to support opposite ends of a turning bar. The shiftable lead screw and spindle are supported for movement in a longitudinal direction as the end of the bar that they support is shifted in a lateral direction. The ends of the bar are supported by hinge joints and the bar itself is rotatable about its own longitudinal axis as it is shifted laterally.

9 Claims, 2 Drawing Sheets

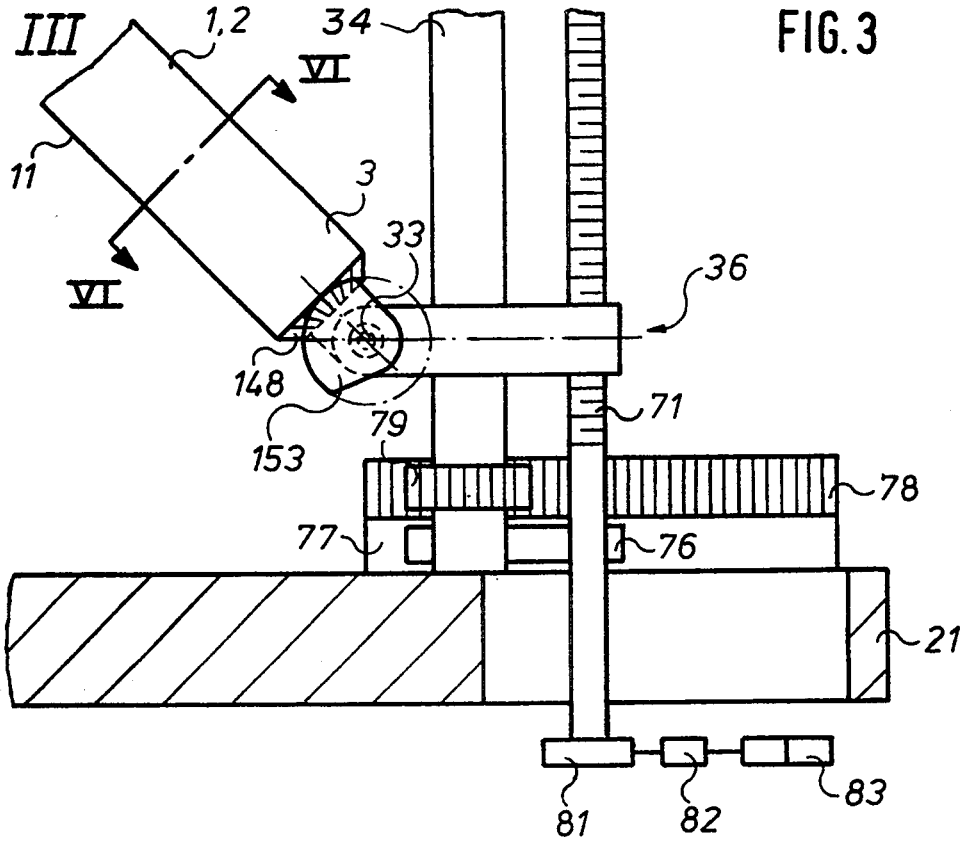
FIG. 3
FIG. 4
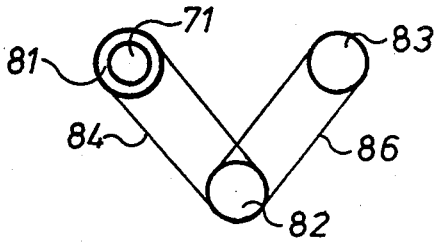
FIG. 6
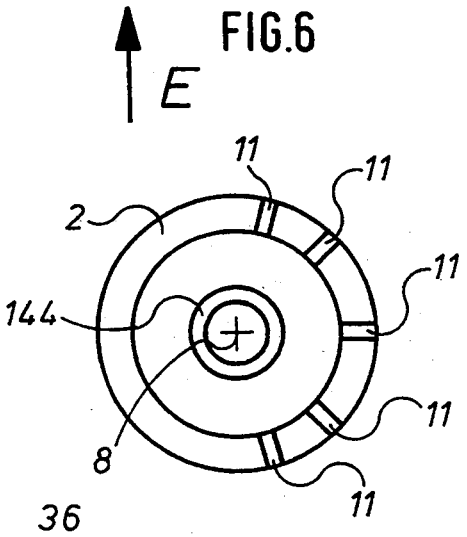
FIG. 5
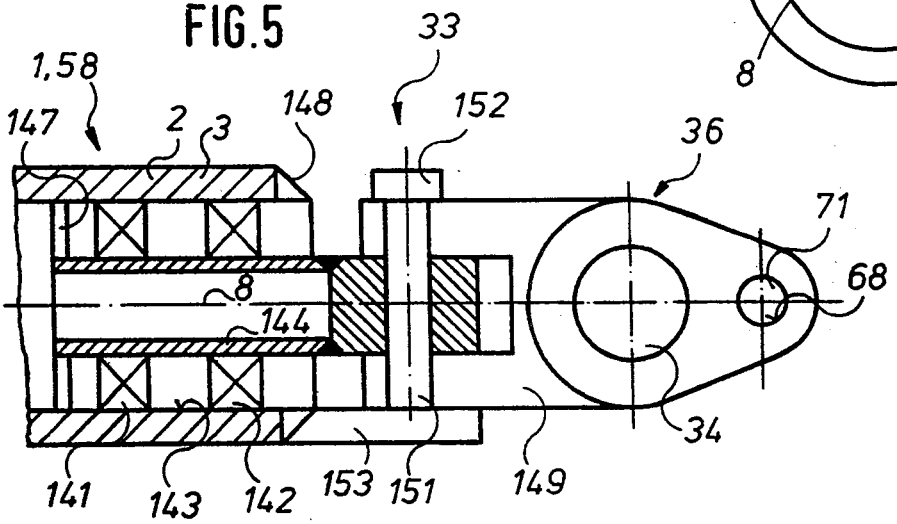

MATERIAL WEB TURNING BAR ASSEMBLY

FIELD OF THE INVENTION

The present invention is directed generally to a material web turning bar assembly. More particularly, the present invention is directed to a paper web turning bar assembly. Most specifically, the present invention is directed to a paper web turning bar assembly in a web-fed rotary printing press. The paper web turning bar or cooperating web turning bars are supported between spaced side frames of the printing press. A first end of each turning bar is supported by a support beam which is movable both laterally between the side frames and also longitudinally with respect to the side frames. As the material web turning bar is shifted through generally 90°, the turning bar itself will also be rotated about its longitudinal axis through 180° so that the bar's air discharge openings will be properly located with respect to the web of paper being turned.

DESCRIPTION OF THE PRIOR ART

Material web turning bar assemblies are generally well known and are typically used in web-fed printing presses to change the direction of travel of a web of paper. Typically, the paper web turning bar is supported between side frames of the printing press so that its orientation with respect to the direction of paper web travel can be changed. A typical prior art support arrangement for a paper web turning bar assembly is shown in German document No. DE 29 20 684 A1.

Paper web turning bars are frequently turned by 90° during production changes so that the direction of web travel can be changed. Since these paper web turning bars are typically provided on at least a portion of their peripheral surfaces with high pressure air discharge jets, it is necessary that these air jets be located on the side of the bar about which the paper web is wrapped. It is often the case that the printing press will be provided with two paper web turning bars that are superimposed one above the other in vertical direction. German patent document No. DE 40 13 229 C1 shows a paper web turning bar arrangement for superimposing ribbons over one another. In this device a first angular turning bar is disposed in a first plane and a parallel angular turning bar is disposed in a second plane. During production changes, these paper web turning bars are shifted or pivoted and their functions are changed. This requires the guiding of the incoming paper web or paper ribbon into a different plane.

One limitation of this prior art device is that a first end of each of these paper web turning bars is secured to its transverse support bar by a hinge joint while a second end of each bar is supported by a sliding guide assembly. This sliding guide assembly receives the web turning bar whose generally cylindrical circumference slides through the sliding guide as the bar is reoriented. This sliding movement between the bar and its support guide is apt to cause the high pressure air discharge openings located in the web turning bar to become clogged with paper dust or other such debris. A further limitation of this prior art sliding guide for the support of one end of the shiftable paper web turning bar is that this support is relatively unstable for continuous operation.

It will thus be seen that a need exists for a material web turning bar assembly which overcomes the limitations of the prior art devices. The paper web turning bar assembly of the present invention provides such a device and is a significant improvement over the prior art devices.

SUMMARY OF THE INVENTION

It is an object of the present invention to provide a material web turning bar assembly.

Another object of the present invention is to provide a material web turning bar for turning a paper web.

A further object of the present invention is to provide a turning bar assembly for a web-fed printing press.

Yet another object of the present invention is to provide a paper web turning bar assembly that can be pivoted through 90°.

Still a further object of the present invention is to provide a paper web turning bar assembly which does not require a sliding guide support for one end of the turning bar.

Even yet another object of the present invention is to provide a paper web turning bar assembly in which the turning bar is rotatable through 180°.

Yet still a further object of the present invention is to provide a paper web turning bar assembly which utilizes superimposed, cooperating turning bars.

As will be discussed in detail in the description of the preferred embodiment which is set forth subsequently, the material web turning bar assembly in accordance with the present assembly utilizes spaced, transversely extending support spindles and lead screws to support each turning bar. The turning bar is secured at both of its ends by hinge joints to a cooperating support spindle and lead screw. One of the spindles and lead screws for each turning bar is movably supported in the press side frames by a crosshead and guide and by a toothed rack and a toothed wheel. A turning bar support beam receives both the support spindle and the lead screw, as well as the end of the turning bar through a hinge joint. As the lead screw is rotated to cause the support beam to move laterally from one side frame toward the other side frame, the support spindle and its associated toothed wheel move longitudinally in the toothed rack. The hinge joint between the end of the turning bar and the support beam also includes a gear arrangement and a support axle which allows the turning bar to rotate through 180° about its longitudinal axis as the turning bar shifts 90° between the spaced side frames.

The material web turning bar assembly of the present invention is far superior to the prior art devices. It does not require that the turning bar be supported at one end in a sliding guide arrangement, as was the prior art. This means that the present turning bar, since it is supported at both of its ends by hinge joints, is much more stable than were the prior art devices. A further advantage is that the hinge joints allow the turning bar to be rotated about its axis as it is shifted with respect to the side frames of the press. This insures that the high pressure air outlet openings will be on the side of the turning bar about which the paper web is wrapped. Further, since there is no sliding guide, these high pressure air outlet openings will not become blocked by paper dust or particles.

Since the paper web turning bars of the present invention can be individually shifted laterally with respect to the press side frames, it is possible to correct a lateral off-center path of travel of the paper web or ribbon being guided and turned. Further, it is possible to position only one of the two support assemblies for one of the web turning bars at a right angle position to the side frames to thus change the angle of the paper web turning bar with respect to the paper web travel path. This also allows an off-center course of travel of a turned paper ribbon to be corrected. In addition, it is also possible to attain pivoting of the web-turning bar for turning the other partial web with a movement in the opposite direction of the two web-turning bar ends. A so-called "crossover" pivot for bay window operation is also possible in accordance with the present invention.

The material web turning bar assembly in accordance with the present invention provides a paper web turning bar that overcomes the limitations of the prior art devices. The present paper web turning bar assembly is a substantial advance in the art.

BRIEF DESCRIPTION OF THE DRAWINGS

While the novel features of the material web turning bar assembly in accordance with the present invention are set forth with particularity in the appended claims, a full and complete understanding of the invention may be had by referring to the detailed description of the preferred embodiment, as is set forth subsequently, and as illustrated in the accompanying drawings, in which:

FIG. 3 is an enlarged detail view of the portion of one of the ends of the turning bar assembly encircled at Y in FIG. 1;

FIG. 4 is a schematic side view of the drive assembly for the turning bar assembly taken in the direction indicated by the arrow E in FIG. 3;

FIG. 5 is a cross-sectional view of one end of a web turning bar in accordance with the present invention, together with its hinge joint and taken along the line V–V of FIG. 1; and FIG. 6 is a cross-sectional view of the web turning bar tube of the present invention and taken along line VI–VI of FIG. 3.

DESCRIPTION OF THE PREFERRED EMBODIMENT

Figure 1:
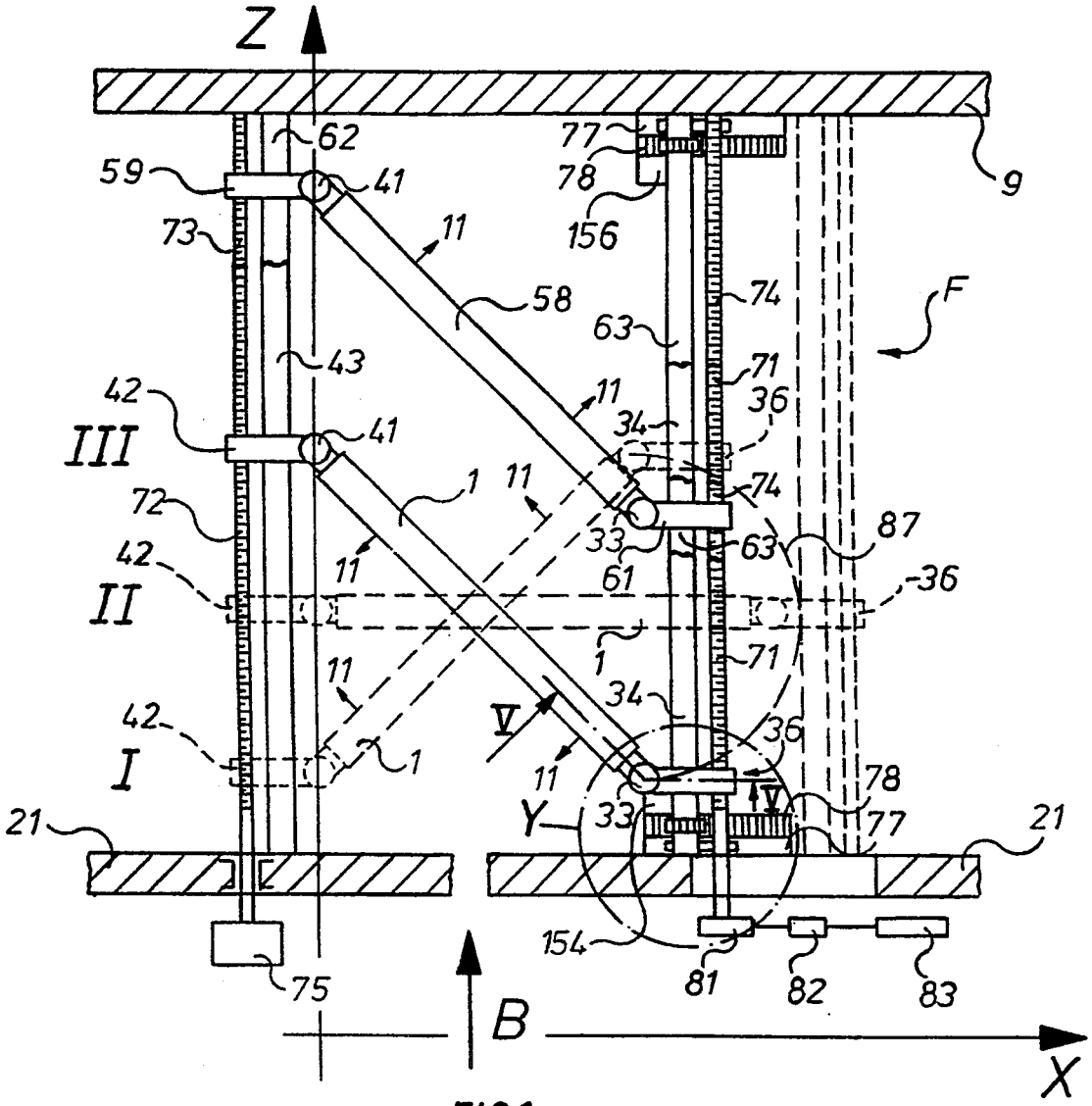
FIG. 1 is a schematic top plan view of two superimposed material web turning bar assemblies in accordance with the present invention.

Referring initially primarily to FIG. 1, there may be seen a preferred embodiment of a material web turning bar assembly in accordance with the present invention. This material web turning bar assembly is intended primarily for use in turning one or more continuous webs of paper in a web-fed rotary printing press. However, it will be understood that the material web turning bar assembly is not limited to such a use and that it could be used with other webs of material. As may be seen in FIGS. 1 and 2 a first paper web turning bar 1 and a second similar paper web turning bar 58 are supported in a vertically superimposed orientation between spaced side frames 9 and 21 of a web-fed printing press. Each of these turning bars 1 and 58 is used to guide and turn an endless paper web which is wrapped about an outer peripheral portion of the turning bar. As may also be seen in FIG. 1, each of these turning bars 1 and 58 is capable of generally pivotal motion in a generally horizontal plane through an angle of generally 90°. As the location of each of these turning bars is changed, typically through positions indicated at I, II, and III in FIG. 1, the paper web which is being guided by the web turning bars 1 and 58 will shift its direction of travel.

Again referring to FIG. 1, and also taken in conjunction with FIG. 3, the web turning bar 1, which is generally tubular in shape, is connected at a first end 3 by a hinge joint, generally at 33 to a first web turning bar support beam generally at 36. The web turning bar support beam 36, as may be seen in FIGS. 2 and 3 has a smooth bore adjacent the hinge joint 33 with this smooth bore rotatably receiving a first support spindle 34. The support beam 36 also has a threaded bore 64 that receives a threaded lead screw 71. The support spindle 34 and the lead screw 71 extend between the two spaced side frames 9 and 21 and together support the first end 3 of the first turning bar 1 for movement between the position I, II and III, as shown in FIG. 1.

Turning again primarily to FIGS. 1 and 3, the support spindle 34 and the lead screw are supported adjacent the side frame 21 by a crosshead 76 which is supported by and retained on a guide 77 for sliding movement along the side frame 21 in a longitudinal direction. The support spindle 34 also carries a toothed wheel 79 which engages a toothed rack 78 that is Joined to the guide 77. An end of the threaded lead screw 71 extends outwardly through a longitudinally elongated slot in the side frame 21 and carries a toothed belt engaging gear wheel 81. This lead screw gear wheel 81 is driven by an electric motor 83 through an intermediate belt gear 82 by toothed drive belts 86 and 84. The intermediate toothed belt gear 82 is supported so that it will compensate for changes in the spacing between the lead screw gear wheel 81 and the electric drive motor 83 that is secured to the side frame 21 as the lead screw moves longitudinally in the slot in frame 21.

As the lead screw 71 is rotated by the electric motor 83 through the belts 86 and 84 and the intermediate gear 82, the web turning bar support beam 36 will move transversely along the lead screw 71, depending on its direction of rotation. As may be seen in FIG. 1, the second end of the lead screw 71 is supported in a second crosshead 76 that also supports a second end of the support spindle 34. A second toothed wheel 79 engages a second toothed rack 78 with the crosshead 76 being slidably retained in a second guide 77 and with the second toothed rack 78 being adhered to the second guide 77. Rotation of the lead screw 71 will thus cause the first turning bar 1, whose length is fixed, to move between the positions I, II, and III. Since the length of turning bar 1 is fixed, the support spindle 34 will move longitudinally in the direction indicated by the arrow X in FIG. 1. The use of toothed wheels 79, the toothed racks 78 and the longitudinally slidable crossheads 76 which are restrained in the guides 77 and are limited to longitudinal travel, will define the path of travel of the first end 3 of the first turning bar 2.

Figure 2:
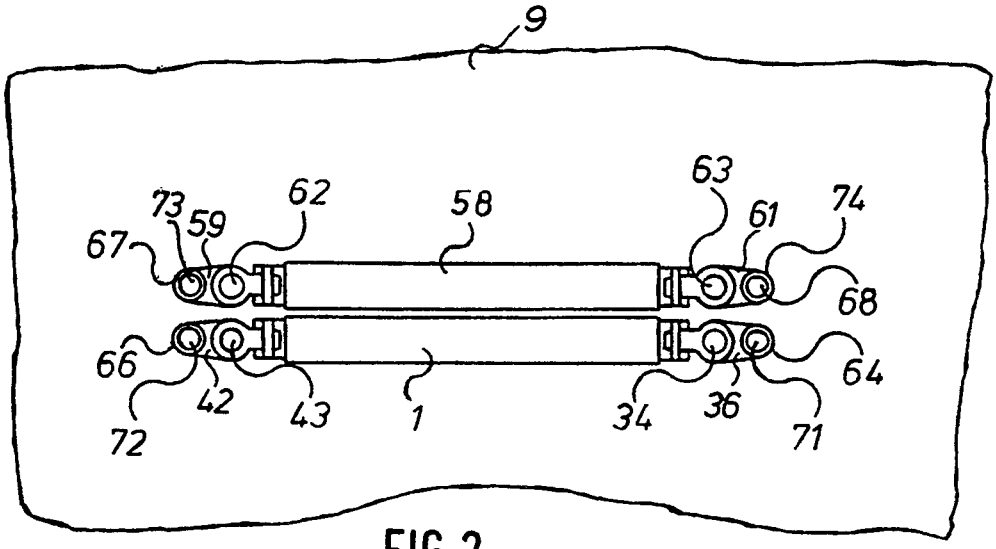
FIG. 2 is a side view of the two superimposed web turning bars, taken in the direction indicated by the arrow B in FIG. 1 and with the side frame removed.

A second end of turning bar 1 is connected by a second hinge joint 41 to a second web turning bar support beam, generally at 42, as shown in FIGS. 1 and 2. This second support beam 42 has a smooth bore that receives a second support spindle 43 and a threaded bore 66 that receives a second lead screw 72. The second support spindle 43 is supported between the spaced side frames and 9 and is not movable. The second lead screw 72 is rotatable supported between the side frames 21 and 9 and has an electric drive motor 75 connected to its end which protrudes beyond the side frame 21. The two motors 83 and 75 can be synchronized so that they will cause the two lead screws 71 and 72 to turn at equal rotational speeds and in opposite directions to move the first paper web turning bar between the positions I, II, and III. Alternatively, the two motors 83 and 75 could be driven at the same speed in the same direction to move the web turning bar 1 transversely between the side frames 21 and 9. Other variations in speed and direction are also possible to accomplish the angular re-orientation of the first paper web turning bar 1.

Turning again to FIGS. 1 and 2 a second paper web turning bar is shown generally at 58. This second turning bar 58 is, as may be seen in FIG. 2 superimposed with respect to, and positioned generally vertically above the first turning bar, generally at 1. The second turning bar 58 is structured the same as the first turning bar 1 and is operated in the same manner. A web turning bar support beam 61 is connected to a first end 3 of the second turning bar by a hinge joint 33 and has a smooth through bore and a threaded bore 68. The smooth bore receives a support spindle 63 and the threaded bore 68 receives a threaded lead screw 74. Although not specifically shown in the drawing figures, it will be understood that this web turning bar support beam 61 is supported and driven in the same manner as was previously discussed with respect to the web turning bar support beam 36 for the first paper web turning bar 1. The cross-heads, guides, toothed racks and drive assembly for this second turning bar 58 are the same as those used for the first turning bar 1.

As may also be seen in FIGS. 1 and 2 the second paper web turning bar 58 is connected by a hinge joint 41 at its second end to a web turning bar support beam 59 that is the same as the beam 42 at the second end of the first turning bar 1. A second threaded lead screw 73 is received in a threaded bore 67 while a support spindle 62 is received in a smooth bore in this support beam 59. An electric motor which is similar to motor 75 is usable to rotate the second lead screw 73 for the support beam 59 at the second end of the second paper web turning bar 58. The second end of the second paper web turning bar 58 is shiftable in the direction indicated by the arrow Z in FIG. 1, as is the first end of the first paper web turning bar 1 by actuation of the drive motor associated with it. In accomplishing this motion, the first paper web turning bar support beam 36 or 61 at the first end of the turning bar 1 or 58 also moves in the X direction, as was discussed above. This results in an arcuate path of travel, as indicated by the curve 87 which is shown in dashed lines in FIG. 1. Suitable stops 154 and 156 are provided on the inner ends of the cylinder 77 and the toothed racks 78 to insure that the first ends of the first and second superimposed paper web turning bars 1 and 58 will not be driven toward the second ends of the bars to a point where the bars might be stressed or bent.

As each of these paper web turning bars 1 and 58 is moved between positions I and III, as seen in FIG. 1, the turning bars are also rotated about their respective longitudinal axes so that the plurality of spaced air jet nozzles placed about a portion of the peripheral surface of each such turning bar will be properly oriented to provide an air bearing effect for the paper web which is wrapped around that surface portion of the turning bar. Referring primarily to FIGS. 5 and 6, the paper web turning bar 1 or 58 is generally in the shape of a hollow, elongated tube 2 that has a first end 3 adjacent this hinge joint 33. The web turning bar support beam 36 has a pair of spaced fork arms indicated at 149. A support axle 144 is secured at a first end between the spaced fork arms 149 by a pin 151 which has an enlarged head 152. The support axle 144 has a central axis of rotation which is coincident with the central axis of rotation 8 of the tube 2 that forms the paper web turning bars 1 and 58. This tube 2 is supported for rotation on the support axle 144 by spaced roller bearings 141 and 142 whose outer races or surfaces are sealingly engaged with an inner surface 143 of the tube 2. A sealing ring 147 is positioned at the end of the support axle 144 which is within the tube 2. At the opposite or second end 4 of each of the paper web turning bars 1 and 58 there is disposed a generally similar support axle 144 and bearings. This second support axle 144 is provided with an opening that is connected by a hose, not specifically shown in the drawings, to a source of compressed air. The tubular support axle 144 has holes through which the high pressure air can flow to the interior portion of the tube 2 between the sealing rings 147. As may be seen in FIG. 6, the tube 2 has a plurality of radially extending air openings 11 that are placed about one half of the peripheral surface of the tube 2 and which extend along the entire length of the tube. These air openings provide a cushion of air to be formed on the outer surface of the paper web turning bars 1 and 58 to act as an air support cushion or friction reducing bearing so that the elongated paper web which is being guided and turned by the paper web turning bars will glide over the surface of the bars.

As the paper web turning bars 1 and 58 are moved between the positions I and III, as depicted in FIG. 1, it is necessary that the tubular portion 2 of each turning bar be rotated through 180° about its longitudinal axis 8 so that the high pressure air discharged through the air openings 11 will be properly oriented with respect to the paper web being turned by the respective web turning bar 1 or 58. As may be seen in FIGS. 1 and 3, the end 3 of each tube 2 is provided with a beveled or conical toothed end 148. These teeth are angled at generally 45° to the vertical. A helically toothed wheel 153 is secured to the bottom arm 149 of the forked arms of the support beam 36. This toothed wheel 153 may actually be only a segment of a wheel, as shown in FIG. 3. The toothed wheel has a number of teeth "D" while the beveled toothed end 148 of the tube 2 has "D/2" teeth. This results in a rotation of the tube 2 through generally 180° as the hinge joint 33 rotates through 90° during movement of the paper web turning bar support beam 36 or 61 between the positions I and III, as shown in FIG. 1.

In operation, and as shown in FIG. 1, the first paper web turning bar 1 is shown in full lines in position III in which its air outlet openings are facing generally in the direction of the side frame 21 as indicated by the small arrow at 11. A half-width paper web (not specifically shown) coming, for example, from the direction of the support spindle 43 on the upper side near the side frame 9 at a 45° to the side frames 9 and 21 is turned through 90° by the turning bar 1 and is then guided out of the paper web turning bar base on the lower side near the side frame 21 in the direction of the support spindle 34. In the orientation depicted in FIG. 1, the second paper web turning bar 58 is oriented with the air outlet openings 11 directed toward the side frame 9, as indicated by the small arrow. As the first paper web turning bar 1 is shifted from position III through position II and into position I, as shown in dashed lines in FIG. 1, the orientation of the air outlet openings 11 is shifted through 180° by rotation of the tube 2 through the cooperation of the bevel tooth ring 148 on the tube and the toothed wheel 153 on the forked arm 149 of the web turning bar support beam 36, as was discussed above. The rotational movement of the tube 2 of the paper web turning bar 1 or 58 through 180° is the result of the use of the number "D" of teeth on the toothed wheel 153 and the number "D/2" of teeth on the bevel wheel 148 on the end of the tube 2.

It would be possible in accordance with the present invention to combine the support spindles 34, 43, 62 and 63 with a toothed rack that was engaged by a toothed wheel seated in the paper web turning bar support beams 36, 42, 59 and 61 and driven by a stepped motor and which forms the support beams on the support spindles.

While a preferred embodiment of a material web turning bar assembly in accordance with the present invention has been set forth fully and completely hereinabove, it will be apparent to one of skill in the art that a number of changes in, for example, the overall size of the assembly, the specific electric drive motors used, the type of bearings used and the like could be made without departing from the true spirit and scope of the present invention which is accordingly to be limited only by the following claims.

I claim:

1. A shiftable material web turning bar assembly for use in a web fed printing press, said assembly comprising:

a printing press having spaced first and second side frames;

a first lead screw and support spindle extending between said first and second side frames;

means supporting said first lead screw and support spindle for movement longitudinally with respect to said side frames;

a second lead screw and support spindle extending between said first and second side frames;

a first material web turning bar extending between said first and second lead screws and support spindles and being hingedly connected at a first end to said first lead screw and support spindle and at a second end to said second lead screw and support spindle; and means to drive said first and second lead screws to shift said first and second ends of said first material web turning bar laterally between said first and second side frames.

2. The turning bar assembly of claim 1 wherein said first end of said turning bar is shiftable longitudinally with said first lead screw and support spindle as said first end of said turning bar is shifted laterally between said first and second side frames.

3. The turning bar assembly of claim 1 wherein said hinged connections between said turning bar and said lead screws and support spindles each include a web turning bar support beam having a threaded bore to receive said lead screw and a smooth bore to receive said support spindle.

4. The turning bar assembly of claim 3 further wherein each said support beam is connected by a hinge joint to an end of said first material web turning bar.

5. The turning bar assembly of claim 4 wherein said first web turning bar is generally tubular and is rotatably supported on a support axle which forms a part of said hinge joint.

6. The turning bar assembly of claim 5 wherein each end of said tubular turning bar has a bevel gear and further wherein each hinge joint includes a gear wheel which cooperates with said bevel gear.

7. The turning bar assembly of claim 1 wherein said first lead screw is driven by a drive means having means to compensate for said longitudinal shifting of said first lead screw and support spindle.

8. The turning bar assembly of claim 1 wherein said first lead screw and said first support spindle are supported at spaced first and second ends by first and second crossheads supported for longitudinal movement by first and second guides secured to said first and second side frames.

9. The turning bar assembly of claim 8 further including a toothed rack secured to each of said first and second guides and a toothed wheel secured to first and second ends of said first support spindle and engaging said first and second toothed racks.

* * * * *